US005558328A

United States Patent [19]

Krantz

[11] Patent Number: 5,558,328

[45] Date of Patent: Sep. 24, 1996

[54] RELATIVE FREQUENCY-BASED WORD GAME

[75] Inventor: Tomas Krantz, Björklinge, Sweden

[73] Assignee: Turn it, Inc., Chicago, Ill.

[21] Appl. No.: 382,888

[22] Filed: Feb. 2, 1995

[51] Int. Cl.[6] ..... A63F 9/04

[52] U.S. Cl. ..... 273/146; 273/272; 434/172

[58] Field of Search ..... 273/146, 272; 434/172, 167

[56] References Cited

U.S. PATENT DOCUMENTS

| | | | |
|---|---|---|---|
| 557,307 | 3/1896 | Foster | 273/146 |
| 830,514 | 9/1906 | Mansfield | 273/146 |
| 1,286,631 | 12/1918 | Hillyard | 273/146 |
| 1,412,204 | 4/1922 | Derby | 273/146 |
| 1,481,628 | 1/1924 | Souza | 273/146 |
| 1,524,529 | 1/1925 | Allen | 273/146 |
| 1,584,316 | 5/1926 | Mayhew | 273/146 |
| 1,684,609 | 9/1928 | Walker | 273/146 |
| 2,491,883 | 12/1949 | Welch | 273/146 |
| 2,739,815 | 3/1956 | Fay | 273/146 |
| 4,383,689 | 5/1983 | Kohner et al. | 273/272 |
| 4,934,700 | 6/1990 | Turek | 273/146 |
| 4,966,366 | 10/1990 | Mercado-Torres | 273/146 |

FOREIGN PATENT DOCUMENTS

| | | | |
|---|---|---|---|
| 1191186 | 10/1959 | France | 273/272 |

OTHER PUBLICATIONS

Zettersten, Arne, *A World Frequency List Based on American English Press Reportage;* Universitetsfurlaget; Kobenhavn, Akademisk Furlag, Copenhagen 1978.

*Primary Examiner*—Benjamin H. Layno
*Attorney, Agent, or Firm*—Marshall, O'Toole, Gerstein, Murray & Borun

[57] ABSTRACT

The present invention is directed to a word game wherein words are formed by arrangement of letters of the alphabet appearing on the faces of a set of dice wherein each letter represented and the number of times the letter is represented in the set of dice, approximates the frequency of their appearance in a corpus of words.

22 Claims, 3 Drawing Sheets

RELATIVE FREQUENCY-BASED WORD GAME

FIELD OF THE INVENTION

The present invention is directed to a word game wherein words are formed by the arrangement of letters appearing on the faces of a set of dice.

BACKGROUND OF THE INVENTION

The present invention is directed to a word game wherein words are formed by arrangement of letters of the alphabet appearing on the faces of a set of dice wherein each letter represented and the number of times that letter is represented in the set of dice, is based on the relative frequency of their appearance in a corpus of words.

The use of dice or cubes displaying letters for use in games or as learning tools is well known. For example, U.S. Pat. No. 557,307 issued Mar. 31, 1896 discloses a spelling block that combines on the surfaces of the blocks, letters, numbers, and pictures that when the blocks are arranged in numerical order, the letters will be in order to correctly spell the word represented by the pictures.

U.S. Pat. No. 830,514 issued Sep. 11, 1906 discloses a board game with letters and "men". The letters are carried on pieces, and several are provided bearing each letter, for example, sixteen of each vowel and eight of each consonant or different numbers of each depending on the frequency of common use in spelling. Preferred are pieces bearing letters on each of more than one face with each face having its own color of letter or background to distinguish the pieces of each player. All of the pieces bear the same combination of colors and backgrounds and each letter appears several times in each color. In one embodiment, the pieces have six faces with each face having a different letter and a different color, with several pieces having the same arrangement of letters, e.g., thirty of which five will have letters in one series of colors, five in a second series of colors, and so on making for the plurality of sets 5×6×5=150 for the alphabet. These pieces may be used in a number of games in which words are spelled out on the board and for which points will be awarded.

U.S. Pat. No. 1,286,631 issued on Dec. 3, 1918 discloses blocks for use as an educational tool by which pupils are taught the formation of simple words by combining the letters on the faces of two blocks wherein the blocks have on certain ones, consonants or combinations of consonants which form the initial part of a word, and on the other blocks, a set of phonograms which form the terminal part of words. Those blocks used in the practice of the invention are divided into two classes; class 1 including those having on each face a single consonant, a digraph or combination of consonants, and class 2 having on each face a phonogram, the arrangement of letters on blocks of the former class may vary, e.g., all the letters on a single block may be the same, or they may be in pairs on opposite faces or the letter on each face of the block may be different. In addition to carrying the initial consonants, the blocks of class 1 can carry the digraphs "ch", "gh", "sh", and "th" and also such combinations as "spl" and "thr". The letters displayed on Class I blocks are printed on a white surface. Class 2 blocks carry the phonograms "a", "e", "i", "o", "u", "w", and "y" printed on red, orange, yellow, green, blue, indigo, and violet respectively, and thus, when the phonograms are arranged in the order of their respective initial vowel, the colors are presented in their proper order.

U.S. Pat. No. 1,412,204 (the '204 patent) issued on Apr. 11, 1922 discloses a game apparatus consisting of several sets of cubes, each set being of a different color from the other sets with each set having printed on each of its faces one letter of a word so that the letters on the six faces of a cube spell a complete word (the target word). In the practice of the invention, each set comprises six cubes, and words are chosen so that no letters are duplicated. In practice, the complete word will be spelled when the six cubes of any set are arranged in such order that the proper faces are uppermost.

The game set out in the '204 patent is played by tossing or rolling the set of cubes in an attempt to spell a target word. The players then attempt to spell the given word, and the highest number of points is awarded for spelling the complete word while correspondingly, fewer points are awarded for the fewer letters of the target word. As an example, 25 points may be awarded for spelling a complete six-letter word, while 20 points would be awarded for the first five letters of the target word, while 15 points may be awarded for the first four letters of the target word, and so on down to 5 points being awarded for the first two letters of the target word.

U.S. Pat. No. 1,481,628 issued Jan. 22, 1924 discloses a dice game simulating poker. The game uses three cubes colored red, white, and blue in a manner such that opposite sides of a cube have the same color with each side of each cube carrying an index or carder representing the suit in playing cards.

U.S. Pat. No. 1,524,529 issued Jan. 27, 1925 discloses a game apparatus including a set of ten cubical blocks, each face of each block having letters displayed thereon. Forty of the faces display the twenty consonants of the alphabet, each duplicated, each two similar consonants being on different dice, with the vowels a, e, i, and o appearing on eight pairs of opposed faces, with the remaining four faces displaying the vowels u and y.

U.S. Patent No. 1,584,316 issued May 11, 1926 discloses a word game that includes a plurality of dice-like cubes or playing pieces bearing on their various faces letters of the alphabet or blanks. While the patent states that the number of playing pieces is not a vital feature of the invention, a game using five pieces is exemplified. According to the patent, the letters chosen for use are the letters of the alphabet from which the greatest number of words can be formed and further, to facilitate the formation of words, the letters on the various pieces are arranged so that they are likely to produce word-forming combinations with letters on the other pieces. More particularly, three or more pieces have one blank face, the remaining faces being provided with vowels or consonant letters; all the consonants being employed except J, K, Q, V, X, Y, Z, which occur with the least frequency, while some such as S and R are employed twice. The invention also utilizes all of the vowels with some such as I and O being employed twice while some such as A and E being used three times. The consonants are placed so that those appearing frequently in words are located on different pieces; the consonants also being placed so that those occurring frequently in words without a vowel between them are on different pieces. Further, the vowels are placed so that those occurring frequently in words without a consonant between them are on different pieces.

U.S. Pat. No. 1,684,609 issued Sep. 18, 1928 discloses a set of dice displaying letters on each face of each die such that when the dice are arranged to expose the spelling of a preselected word on the uppermost face of the dice, the side and front faces of the dice will expose the spelling of words which will read in sense-making, continuing with the first words.

U.S. Pat. No. 2,491,883 issued Dec. 20, 1949 (the '883 patent) discloses a game apparatus comprising four cubes, each cube having a letter on each of its faces, one of the cubes having the vowel letters A, E, I, O, and U on five of its faces, the sixth face having an indicia thereon, a second cube having three vowel letters and three consonant letters thereon, with the remaining cubes having only consonants letters thereon. In another embodiment, the game comprises a set of four cubes having the same distribution of vowels as described in the first embodiment on one cube, a second cube having the vowel letters A, E, and O and different consonants on the remaining faces with the remaining two cubes having only unlike consonant letters thereon. In still another embodiment, the game comprises a plurality of cubes, each cube having a letter on each of its faces and adjacent to each letter a number, one of the cubes having only vowel letters on five faces thereof and an indicia on the sixth face, another cube having three different vowel letters and three different consonant letters on its faces, the remaining cubes having only consonant letters on their faces. Another embodiment of the invention disclosed in the '883 patent comprises a game apparatus comprising a plurality of cubes, each cube having an alphabetical letter on each of its faces and adjacent to each letter an integer of a value substantially inversely proportional to the frequency of the particular letter's occurrence in words, one of the cubes having different vowel letters on five faces thereof at an indicia on the sixth face, another cube having three different vowel letters on three faces thereof and three consonant letters on the remaining three faces, with the remaining cubes having only consonant letters on their faces.

U.S. Pat. No. 4,934,700 issued Jun. 19, 1990 discloses a dice word game set and a method of playing a dice word game. Each side of each die of a set of dice is marked with a unique letter of a target word so that the die contains all letters of a target word. To play the game, each player is given a set of dice, one for each letter in a target word. The player rolls one die, attempting to roll the first letter of the target word. If the roll is successful, the die is added to a completion set that partially spells the target word, and the player attempts to roll the next letter in the target word. When a player has completed the target word, he wins the game.

U.S. Pat. No. 4,966,366 issued Oct. 30, 1990 (the '366 patent) discloses a matching word game comprising a set of six-sided cubes, the number of which is equal to the number of letters in a pre-selected word, and wherein each face of each cube bears a different letter and some sides of a different cube bearing the same letter allegedly in accordance with the approximate frequency of usage of the letters in a word. The number of cubes in a set must provide a total number of faces, in multiples of six, substantially greater than the number of letters in the alphabet in order that letters can be distributed at random among the faces of the cubes of the set in accordance with their frequency of use in the language, with no letter being repeated on a single cube. One cube may bear two letters of a selected word, one or more of these letters being also repeated on other cubes of the set. In order to correctly match a word, a player must arrange the cubes correctly so that each letter is selected from a cube that does not also carry another letter of the word, which cannot be provided by any other cube. Each player has a set of cubes, and the winner is determined by whomever arranges his cubes to spell the preselected word in the shortest possible time. The game further comprises a plurality of cards each bearing a preselected word composed of letters, each of which appears on a face of a separate cube. However, examination of the letters used and the number of times each letter is used in the practice of the '366 patent reveals that the letter usage does not accurately reflect their actual relative frequency (see below).

SUMMARY OF THE INVENTION

The present invention is directed to a game apparatus comprising a plurality of polygonal dice, each die having a plurality of faces and wherein each face bears one or more letters of an alphabet, and wherein the frequency of appearance of a letter on the plurality of dice is based on its relative frequency of occurrence in a corpus of words.

In a preferred embodiment of the present invention, the letters are placed on the dice so as to avoid the placement of common bigrams on a dice. Further, according to the present invention, no letter appears more than once on any die. Also, in a preferred embodiment of the present invention, the vowels are distributed evenly among the plurality of dice. However, it is also envisioned that one die of the plurality of dice bears only vowels. A preferred embodiment of the present invention comprises 12 six-sided dice.

In another aspect of the present invention, one or more faces of the dice may bear a pair of letters. In still another aspect of the present invention, at least one letter of a pair of letters displayed on the face of a dice is a letter having a low relative frequency of occurrence in the corpus. The present invention also comprehends the use of at least one face of one die to represent any letter of an alphabet.

In another aspect of the present invention the game apparatus comprises a plurality of polygonal dice, each die having a plurality of faces wherein each face bears one or more letters of an alphabet, and wherein each letter of the alphabet is represented at least once, and wherein the frequency of appearance of a letter on the plurality of dice reflects the approximate frequency of occurrence of the letter in a corpus of words.

The present invention is also directed to a method of playing a word game comprising the steps of rolling the game apparatus according to the present invention using letters displayed on the dice resulting from the roll to compose one or more words, and awarding points according to the number of letters used in each of the one or more words composed. The present invention is also directed to a method of playing a word game as described above wherein bonus points may be awarded when a composed word matches a preselected bonus word.

Still another aspect of the present invention is a symbol word game apparatus comprising a plurality of polygonal dice each die having a plurality of faces and wherein each face bears one or more symbols, and wherein the frequency of appearance of a symbol on the plurality of dice reflects the approximate frequency of occurrence of the symbol in a corpus of symbol words.

The present invention is also directed to a method of playing a symbol word game comprising the steps of rolling the game apparatus according to the present invention using symbols displayed on the dice resulting from the roll to compose one or more symbol words, and awarding points according to the number of symbols used in each of the one or more symbol words composed.

DETAILED DESCRIPTION

Figure 1:
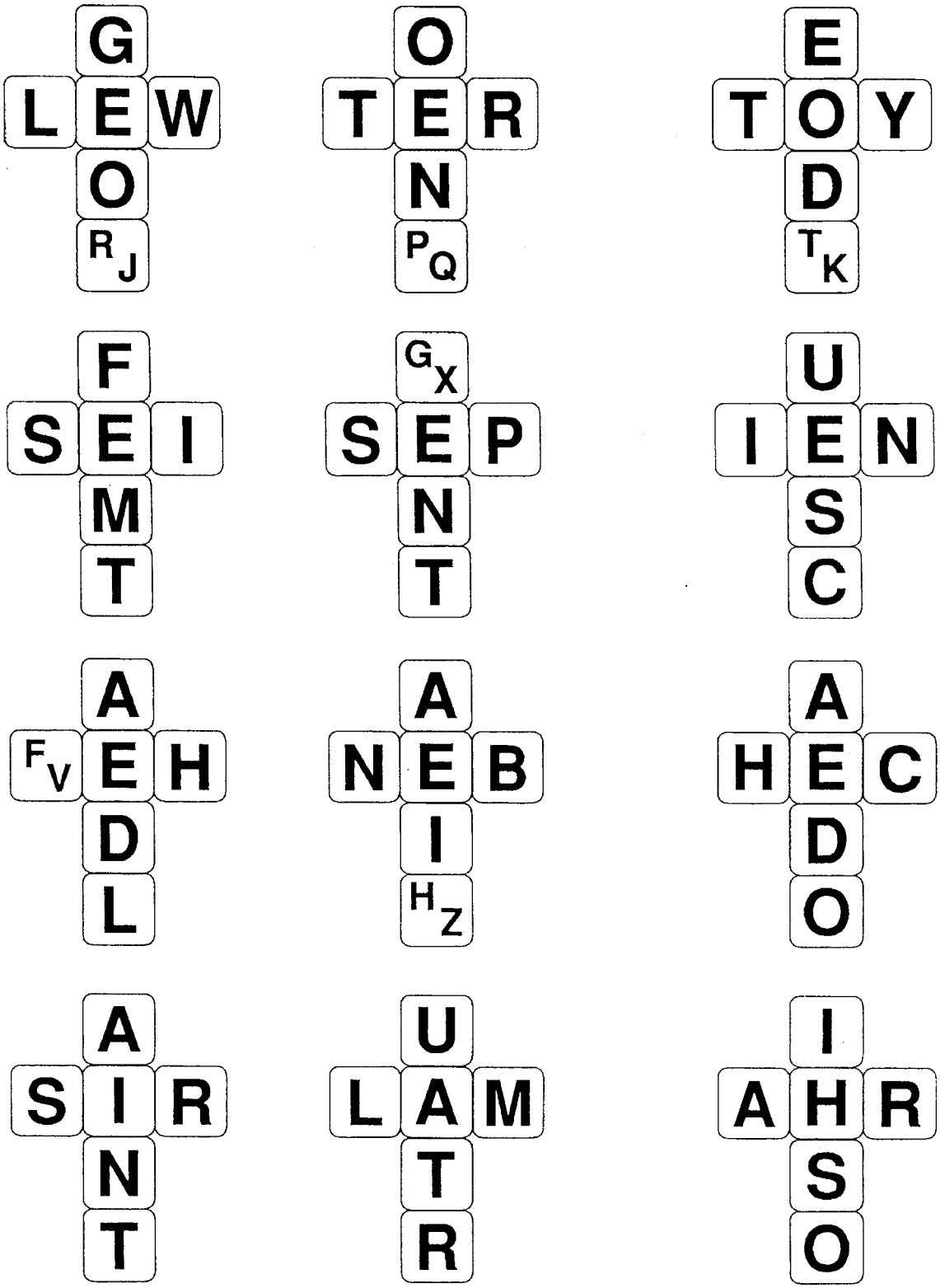
FIG. 1 is a planar representation of a set of dice according to the present invention showing the distribution of letters on the faces of the dice.

The present invention is directed to a word game apparatus comprising a plurality of cubes or other polygonal game pieces (dice) displaying on each face of each die a letter of an alphabet and wherein the letters are represented in the set of dice at a frequency approximating their relative frequency of appearance in a corpus of words.

The invention is also directed to a method of playing a word game using the apparatus of the present invention. More particularly, according to a method of the present invention, the plurality of dice of the game apparatus are rolled by a player who then uses the letters displayed on a selected face of the dice to compose one or more words. In a preferred embodiment, the letter selected is displayed on the uppermost face of the dice resulting from the roll. Points are awarded to the player according to the number of letters used to compose the word or words.

In a preferred embodiment, the number of dice used in the practice of the present invention is selected so as to accommodate all or most of the letters of an alphabet at least once and to approximate the relative frequency of occurrence of the letters in a corpus of words, with the letters having the highest relative frequency in the corpus being represented most often on the dice. The practice of the present invention does not require that all the letters of an alphabet be used, only that the letters used are represented in a set of dice based on their relative frequency of appearance in a corpus (see below).

The relative frequency of letter appearance in a corpus as used in the present invention is illustrated in Table 1 and is based on a frequency analysis set out in Zettersten, Arne, *A Word Frequency List Based on American English Press Reportage*, Universitetsfurlaget; København, Akademisk Furlag, Copenhagen 1978, the entirety of which is incorporated herein by reference. This frequency table is based on the frequency of letters in Category A of the *Brown University Corpus of Present-Day American English*, Francis et al., Brown University, Providence, R.I. (1961) (the "Brown Corpus") which represents a word frequency list consisting of 44 samples of about 2,000 words each taken from United States "Press:Reportage". However, the frequency analysis used for determining the letter selection used in the present invention is not limited to that set out in Arne. Any method of frequency analysis of any corpus in any language may be used as a guide in selecting the letters for use in the practice of the present invention so long as the analysis enables the determination of the relative frequency of usage of a letter in a corpus. See, e.g., Smith, L. D. 1943, *Cryptography*, Norton, N.Y.; Thorndike, E. L. and Lorge, I 1944, *The Teachers Word Book of* 30,000 *Words*, Teachers College, Columbia University; Attneave, F. 1953 *"Psychological Probability as a Function of Experienced Frequency"*, Journal of Experimental Psychology, Vol, 46, No. 2, pp. 81–86, *The Encyclopedia Americana,* 1956, New York: Americana Corp., Underwood, B. J. and R. W. Schultz, 1960, *Meaningfulness and Verbal Learning*, Chicago: Lippincott, Mayzner, M. S. and M. E. Tressect. 1965. Tables of single letters and bigram frequency counts for various word-length and letter-position combinations. *Psychonomic Monograph Supplements*, Vol. I, No. 2, pp. 13–78; and Fang, I. 1966, *"It isn't ETAOIN SHRDLU*; It's ETAONI RSHDLC". Journalism Quarterly, 43, pp. 761–762, all of which are incorporated herein by reference. The invention also contemplates an embodiment based on the relative frequency of letters as they occur in a dictionary. Exemplary dictionaries include *Websters Third International Dictionary*, Merriam-Webster Inc., Springfield, Mass. (1986).

A preferred embodiment of the present invention, comprises twelve dice, each die being a cube having six faces. However, the number of dice and their shape may vary so long as the number of each letter used and their distribution on the faces of the dice permits a close approximation of the relative frequency of occurrence of letters in the corpus. Twelve dice were selected for the preferred embodiment because it readily allows the use and placement of the least frequent letters. The use of fewer or more than twelve dice is also contemplated by the present invention. However, using twelve dice not only permits the advantages discussed above, but also provides a convenient and easily managed number of dice for the player.

Twelve dice, each having six faces, provides 72 faces on which to display letters of the alphabet. The letters and the number of times each letter is used in the set of dice was determined by its relative frequency of occurrence in a corpus of words as illustrated in Table 1. Table 1 also illustrates the number of times each letter of the alphabet appears in the preferred embodiment of 12 six-sided dice. As is apparent from Table 1, and as explained below, the number of letters displayed on the 72 faces of the preferred embodiment is actually 78.

TABLE 1

| Letter | Relative Frequency | ×.72 | Number of Each Letter In a 12-Die Set | Percent of Total |
|---|---|---|---|---|
| E | 12.3 | 8.91 | 9 | 12.5 |
| T | 9.12 | 6.57 | 7 | 9.7 |
| A | 8.39 | 6.04 | 6 | 8.3 |
| O | 7.44 | 5.36 | 5 | 6.9 |
| N | 7.21 | 5.19 | 5 | 6.9 |
| I | 7.06 | 5.08 | 5 | 6.9 |
| S | 6.56 | 4.72 | 5 | 6.9 |
| R | 6.54 | 4.71 | 5 | 6.9 |
| H | 5.02 | 3.62 | 4 | 5.5 |
| L | 4.25 | 3.06 | 3 | 4.1 |
| D | 3.97 | 2.86 | 3 | 4.1 |
| C | 3.19 | 2.29 | 2 | 2.7 |
| M | 2.65 | 1.90 | 2 | 2.7 |
| U | 2.57 | 1.85 | 2 | 2.7 |
| F | 2.22 | 1.60 | 2 | 2.7 |
| P | 2.04 | 1.46 | 2 | 2.7 |
| G | 1.93 | 1.39 | 2 | 2.7 |
| W | 1.75 | 1.26 | 1 | 1.3 |
| Y | 1.69 | 1.21 | 1 | 1.3 |
| B | 1.62 | 1.16 | 1 | 1.3 |
| V | .98 | <1 | 1 | 1.3 |
| K | .73 | <1 | 1 | 1.3 |
| J | .23 | <1 | 1 | 1.3 |
| X | .20 | <1 | 1 | 1.3 |
| Q | .089 | <1 | 1 | 1.3 |
| Z | .079 | <1 | 1 | 1.3 |

The number of times each letter is represented in the preferred embodiment of twelve six-sided dice having 72 faces is determined by multiplying the relative frequency of that letter in the corpus by 0.72 and rounding that product (over 0.5 rounded up and under 0.5 rounded down) to the nearest whole number. As can be seen in Table 1, there are six letters whose relative frequencies yield numbers less than one when multiplied by 0.72. However, according to the preferred embodiment of the present invention despite their low relative frequency, those letters may appear once in the set of dice. The use and placement on the dice of the least frequent letters in the corpus allows the player the possibility of composing more words or longer words than would otherwise be possible thereby creating a more interesting, fun, and intellectually challenging game. In other embodiments of the present invention, the least frequent letters may be eliminated with the realization that the number and length of words available to the player may be reduced.

In the preferred embodiment of the present invention, all of the letters of the alphabet are used although use of all of the letters is not required by the present invention. Including all of the letters of the alphabet according to their relative frequency of use in a corpus requires more than the 72 faces available in the 12 dice set. To get around this and to provide for the inclusion of extra infrequent letters (2 Gs and 2 Ps) thereby increasing the number and length of words available to the player, it was decided to use two-letter combinations on one or more of the die faces, for example, making it possible to display a total of 78 letters on the 72 faces. Letters on these two-letter sides have therefore a greater chance of coming up on a roll than is reflected by their relative frequency. However, the rules for the practice of the method of the present invention may allow use of only one letter of two-letter combinations per turn, and thus, these letters would not be used every time they appear, thereby reducing their (actual use) frequency in the game. In selecting the letter combinations for the two-letter combinations, an attempt was made to select letters which are not often used together or which are represented often on other dice.

Figure 3:
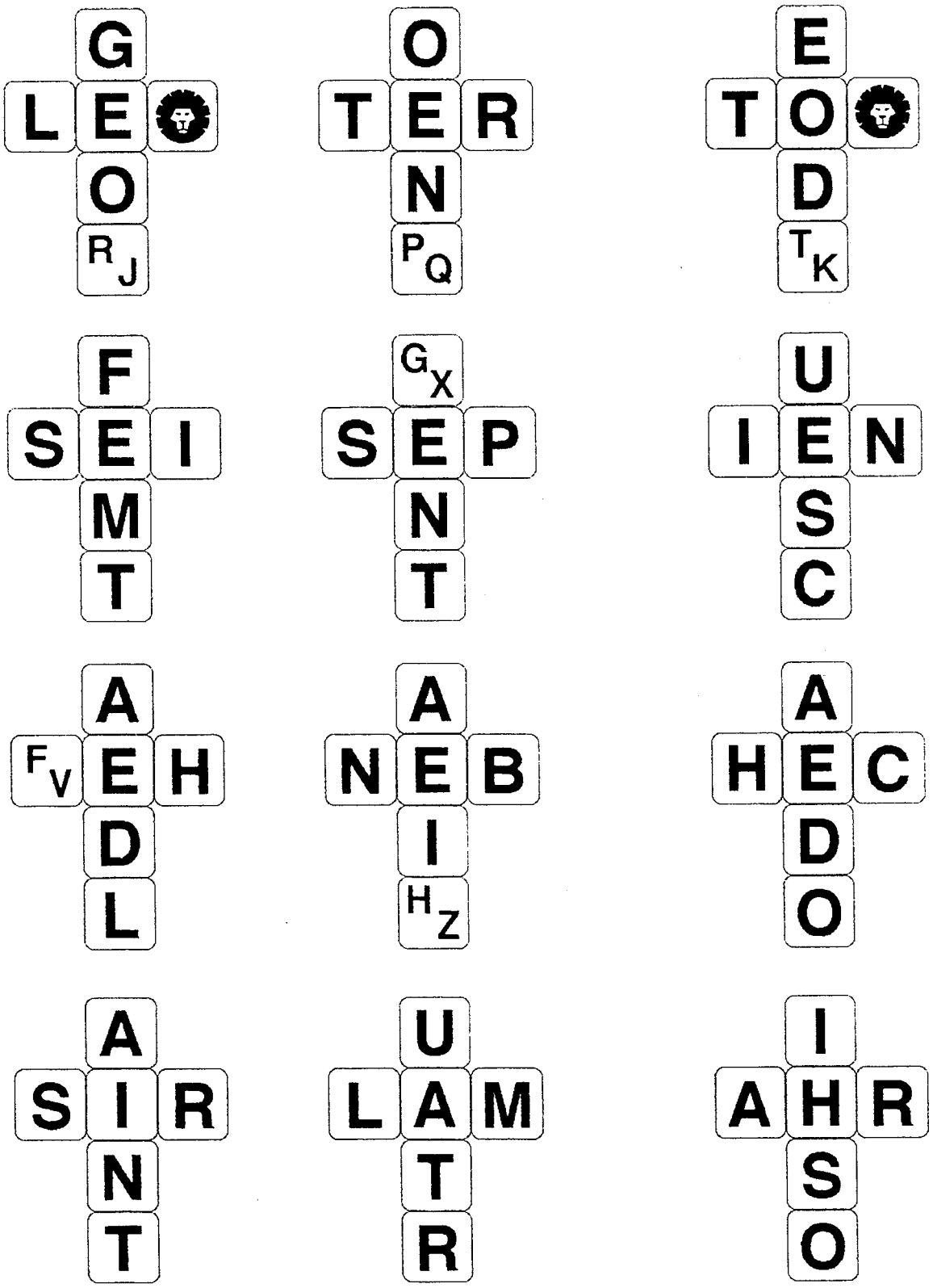
FIG. 3 is a planar representation of a set of dice according to the present invention showing the distribution of letters on the faces of the dice, including one die bearing a symbol which represents any letter of the alphabet.

To further expand the number and length of words available to the player, the invention also contemplates the use of one or more joker sides (free choice of letter). The joker side may be represented by a blank face or a word, letter, or design (FIG. 3).

In a dice set comprising more than 12 dice or in a dice set having more than 72 sides on which to display a letter, the number of times a letter having a low frequency (e.g. letters having a relative frequency of less than 1.93 as shown in Table 1) can be used may be increased so long as the number of times it is represented is based on its relative frequency in a corpus.

As discussed above, U.S. Pat. No. 4,966,366 (the '366 patent) discloses a matching word game in which letter selection is purportedly based on the approximate frequency of letter usage in words. However, as shown in Table 2, letter usage in the '366 patent does not reflect the relative frequency of letter usage as does the present invention. The data in Table 2 were derived from FIG. 5 of the '366 patent which sets out the letter usage and distribution in the disclosed game. The data from FIG. 5 of the '366 patent was collated and set out in Table 2 so as to facilitate comparison to the relative frequency and letter usage of the present invention.

TABLE 2

| Letter | Number of Each Letter | Percent of Total |
|---|---|---|
| E | 6 | 10.0 |
| T | 2 | 3.3 |
| A | 4 | 6.67 |
| O | 4 | 6.67 |
| N | 2 | 3.33 |
| I | 4 | 6.67 |
| S | 2 | 3.33 |
| R | 2 | 3.33 |
| H | 2 | 3.33 |
| L | 2 | 3.33 |
| D | 2 | 3.33 |
| C | 2 | 3.33 |
| M | 2 | 3.33 |
| U | 4 | 6.67 |
| F | 2 | 3.33 |
| P | 2 | 3.33 |
| G | 2 | 3.33 |
| W | 2 | 3.33 |
| Y | 4 | 6.67 |
| B | 2 | 3.33 |
| V | 1 | 1.66 |
| K | 1 | 1.66 |
| J | 1 | 1.66 |
| X | 1 | 1.66 |
| Q | 1 | 1.66 |
| Z | 1 | 1.66 |

As can be seen in Table 2, E is represented nearly correctly (10%) with respect to its relative frequency in a corpus and its corresponding use in the game. However, the other four vowels are equally represented regardless of their relative frequency. Thus U and Y occur as often as A, I, and O despite their different relative frequencies. Also, as shown in Table 2, U and Y, occur more often than several more frequent consonants (e.g. T,N,S,R,H,L,D,C,and M). With regard to consonant usage in the '366 patent, B, with a relative frequency of 1.6 is represented as often as T which has a relative frequency of 9.1. The failure of the '366 patent to reflect the relative frequency of use of letters in a corpus necessarily limits the number of words available to the player and thereby limits the creative dimensions of the game.

One of the guiding principles used in determining the distribution of letters in the set of dice of the present invention is that no letter may appear more than once on a given die. This was done in an attempt to reflect the relative frequency of letters in the corpus as closely as possible and to better allow for the many words having more than one of the same letter in them. For example, placing E on six sides of one die ensures that E will come up every roll. However, in that case, the likelihood than another E on another die would be less than its frequency in the corpus. In that case more is left to the chance of the roll than to the imagination and intellect of the players, thereby reducing the creative dimensions to the game. The challenge of the game lies in the letters reflecting their use in the language and in the possible variations resulting from that distribution.

Further, letter combinations on each individual die are not determined separately from one another. For example, in selecting and arranging the letters used in the preferred embodiment of 12 dice, the letter E was first placed on nine different dice. T was then placed to avoid the placement of all Ts on E dice. The same applied for A, O, N, I, S, and R in that order. Following down Table 1, the other letters were placed in order, while attempting to avoid placement of the more frequent bigrams and other letter combinations (e.g. ion, ous, ing, etc.) on the same die (see below).

While the number of dice does not influence directly what letters are selected for each die, fewer dice would decrease the possibilities for avoiding putting frequent bigrams and desired letter combinations on the same die.

As discussed above, the arrangement of letters on the dice of the present invention also takes into account the frequency of two-letter combination (bigrams) in a corpus and seeks (for the most part) to avoid having the two letters of a frequently occurring bigram on a single dice, thus helping maximize the number of words available for use in the game. Zettersten et al, supra sets out the 30 most frequent bigrams in the corpus. The most frequent bigrams in the corpus according to Zettersten are "TH" followed by "HE", "IN", "ER", "AN", "ON", "RE", "AT", "EN", "OR", "ES", "TE", "ED", "ND", "AR", "ST", "TO", "TI", "NT", "IT", "AL", "IS", "AS", "OF", "NG", "HA", "LE", "CO", "OU", and "ME".

Because TH is the most common bigram, the placement of T and H on the same die is avoided. However, since the two most common letters, E and T are on so many dice, it was necessary to place three of the four H's on E dice, despite the common bigram HE. Thus, placement of H was done to avoid combinations with T, S, and C. Further, the frequency of bigrams is not solely determinative with respect to their appearance on a die. For example, bigrams like SH and CH are not listed in the top thirty most frequent bigrams discussed above, but were considered in determining the B distribution of letters on the dice for the purpose of maximizing the number of words available to the player. As shown in FIG. 1, three non-E dice all have A. Since the bigram AT is more frequent than TE, this required that T also not be placed on each of the three non-E dice. Additionally, the bigrams AN and EN are problematic in that E or A are on every die, so the placement of N must be balanced between the dice displaying the two vowels. It should also be recognized that combinations with E are unavoidable with so many of that letter and so must be accepted.

Figure 2:
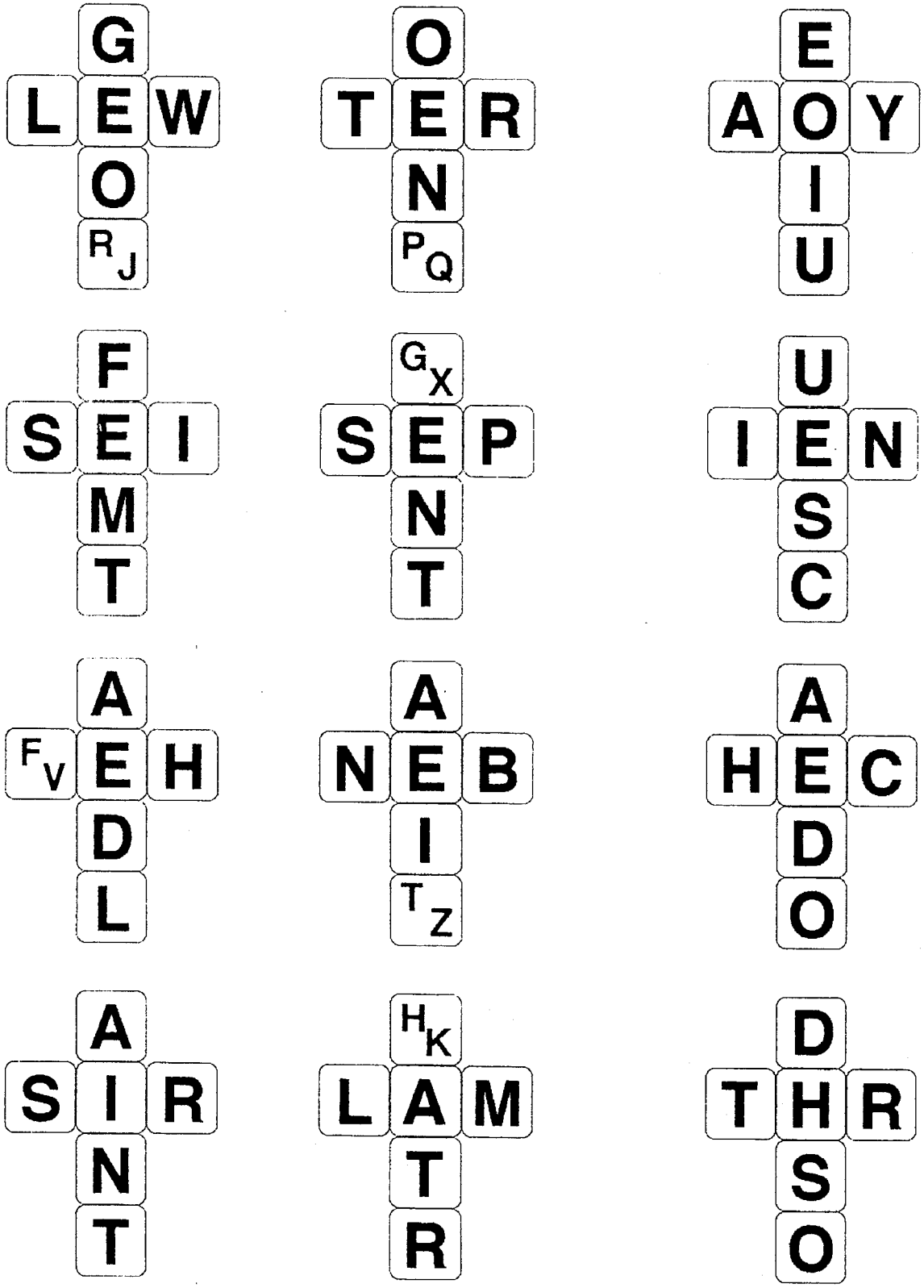
FIG. 2 is a planar representation of a set of dice according to the present invention showing the distribution of letters on the faces of the dice, including one die bearing only vowel letters.

Another consideration concerning the placement of letters is the spread of vowels on all the dice. This consideration affects the placement of certain letters to avoid certain bigrams as stated above. The spread of vowels results in the possibility of getting "aced" where no vowels appear after the roll of the dice. One way to avoid this problem would be to provide at least one die with all vowels and this is contemplated by the present invention (FIG. 2). However, because the chance of such an ace is small, and is smaller the more evenly placed the vowels are among all the dice, placing the vowels evenly in this manner is also contemplated by the invention. This consideration influences the choice of the number of dice used in the preferred embodiment of the game described above. Therefore, in a preferred embodiment, the vowels are evenly spread on all the dice to the extent possible without running afoul of the guidelines set out above. FIG. 1 shows a preferred embodiment of the present invention including 12 dice each having six faces wherein the letter selection and distribution was determined according to the guidelines set out above.

Another aspect of the present invention is a method of playing a game using the apparatus of the present invention. To play the game, a player rolls the dice, and using the letters displayed on a face of the dice, the player attempts to compose a word or words using those letters. The letter may be selected from the uppermost face of the dice as in the preferred embodiment, or from any other selected face of the dice. As discussed above, only one letter of a pair displayed on the face of a die may be used. One example of a scoring scheme is shown below in Table 2.

TABLE 3

| | Scoring | | | | | | | | | | |
|---|---|---|---|---|---|---|---|---|---|---|---|
| No. of Letters | 2 | 3 | 4 | 5 | 6 | 7 | 8 | 9 | 10 | 11 | 12 |
| Points | 3 | 5 | 7 | 11 | 15 | 19 | 23 | 28 | 33 | 39 | 48 |

As can be seen from Table 3, the scoring system places a premium on using as many letters as possible. In another embodiment of the present invention, additional bonus points or premium points may be awarded to a player for composing a single word longer than a preselected minimum length thereby increasing the challenge and commensurately rewarding the more skilled and intelligent player. For example, a player composing a single word having seven letters would score more points than a player who composes two words, one four letters in length and another three letters in length. In one embodiment of the invention, bonus points may be awarded if player can use the letters to compose a preselected bonus word.

Still another aspect of the method of the present invention includes the use of a timer to limit the time available to the player to compose words from the letters displayed on the dice. This promotes more rapid play and rewards the more highly skilled player.

While the forgoing description is directed toward a word game wherein letter usage is determined by the relative frequency of letters in a corpus, the present invention also contemplates an analogous symbol game wherein a set of symbols may be arranged to convey meaning ("symbol words") so long as symbol usage reflects the relative frequency of symbol usage in a corpus of symbol words.

The description of the invention set out above is presented by way of illustration and is not intended in any way to limit the invention as set out in the appended claims.

I claim:

1. A game apparatus for forming words from letters appearing on word game dice comprising:

twelve word game dice having seventy-two faces, six faces on each die of said dice;

sixty-six of said faces displaying one letter of an alphabet having the letters A, B, C, D, E, F, G, H, I, J, K, L, M, N, O, P, Q, R, S, T, U, V, W, X, Y, and Z, the remaining six of said faces each displaying two of said letters of said alphabet appearing together; and nine of said faces displaying said letter E, seven of said faces displaying said letter T, six of said faces displaying said letter A, five of said faces displaying said letter O, five of said faces displaying said letter N, five of said faces displaying said letter I, five of said faces displaying said letter S, five of said faces displaying said letter R, four of said faces displaying said letter H, three of said faces displaying said letter L, three of said faces displaying said letter D, two of said faces displaying said letter C, two of said faces displaying said letter M, two of said faces displaying said letter U, two of said faces displaying said letter F, two of said faces displaying said letter P, two of said faces displaying said letter G, one of said faces displaying said letter W, one of said faces displaying said letter Y, one of said faces displaying said letter B, one of said faces displaying said letter V, one of said faces displaying said letter K, one of said faces displaying said letter J, one of said faces displaying said letter X, one of said faces displaying said letter Q, and one of said faces displaying said letter Z, said letters being arranged on said dice so that no two letters appear more than once on a die and to maximize the possible number of words which may be formed.

2. The game apparatus of claim 1 wherein one of said faces is a joker face, said joker face representing any letter of said alphabet.

3. The game apparatus of claim 2 wherein said joker face is a design.

4. The game apparatus of claim 1 wherein said letters are arranged among said dice such that said six faces having two letters appearing together thereon include two-letter combinations RK, PQ, TJ, GX, FV, and HZ, respectively.

5. The game apparatus of claim 1 wherein one die of said dice displays said letters A, E, I, O, U, and Y.

6. The game apparatus of claim 5 wherein said letters are arranged among said dice such that the appearance of frequently occurring bigrams on any one die of said dice is minimized, said frequency of occurrence of said bigrams being based upon the relative frequency of occurrence of said bigrams in a corpus of words.

7. The game apparatus of claim 1 wherein said letters are arranged among said dice such that said letters A, E, I, O, U, and Y each appear on a different die.

8. The game apparatus of claim 7 wherein said letters are arranged among said dice such that the appearance of frequently occurring bigrams on any one die of said dice is minimized, said frequency of occurrence of said bigrams being based upon the relative frequency of occurrence of said bigrams in a corpus of words.

9. A method for arranging on a plurality of word game dice a plurality of letters of an alphabet appearing in a corpus of words, said dice having a total number of faces thereon, comprising the method of a) determining a relative frequency of appearance of each of said letters in said corpus of words;

b) multiplying said relative frequency of appearance of each said letters by said total number of faces to receive a product for each of said letters;

c) dividing said product for each of said letters by one hundred to receive an initial number for each of said letters;

d) rounding said initial number for each of said letters to the nearest whole number to receive a final number for each of said letters, said final number for each of said letters representing the number of faces of said dice on which each of said letters will be displayed; and e) displaying said final number of each of said letters on said dice such that none of said letters am displayed more than once on any one of said dice and such that placement of common bigrams on any one die is minimized, said method of arranging resulting in an arrangement of letters on the dice that maximize the numbers of words that can be formed using said letters displayed on said dice.

10. The method of claim 9 wherein each letter of said alphabet is represented at least once in said dice.

11. The method of claim 9 wherein said plurality of letters includes vowel letters and wherein one die of said dice includes only vowel letters.

12. The method of claim 9 wherein said plurality of letters includes vowel letters and step e) further includes evenly distributing said vowel letters among said dice.

13. The method of claim 9 wherein step e) further includes displaying together two of said letters on one face of one die of said dice.

14. The method of claim 13 wherein one of said two letters displayed together on one face of one die has a low relative frequency of appearance in said corpus of words.

15. The method of claim 13 wherein one of said two letters displayed together is represented in the set of dice two or fewer times.

16. The game apparatus of claim 9 wherein said common bigrams include TH, HE, IN, ER, AN, ON, RE, AT, EN, OR, ES, TE, ED, ND, AR, ST, TO, TI, NT, IT, AL, IS, AS, OF, NG, HA, LE, CO, OU, and ME.

17. The game apparatus of claim 9 wherein said corpus comprises non-English words.

18. A method for arranging on a plurality of symbol game dice a plurality of symbols appearing in a corpus of symbol words, said dice having a total number of faces thereon, comprising the method of a) determining a relative frequency of appearance of each of said symbols in said corpus of symbol words;

b) multiplying said relative frequency of appearance of each said symbols by said total number of faces to receive a product for each of said symbols;

c) dividing said product for each of said symbols by one hundred to receive an initial number for each of said symbols;

d) rounding said initial number for each of said symbols to the nearest whole number to receive a final number for each of said symbols, said final number for each of said symbols representing the number of faces of said dice on which each of said symbols will be displayed; and e) displaying said final number of each of said symbols on said dice such that none of said symbols are displayed more than once on any one of said dice and such that placement of common bigrams on any one die is minimized.

19. The method of claim 18 wherein each symbol is represented at least once in said dice.

20. The method of claim 18 wherein step e) further includes displaying together two of said symbols on one face of one die of said dice.

21. The method of claim 20 wherein one of said two symbols displayed together has a low relative frequency of appearance in said corpus of symbol words.

22. The method of claim 20 wherein one of said two symbols displayed together is represented in the set of dice two or fewer times.

* * * * *

UNITED STATES PATENT AND TRADEMARK OFFICE

CERTIFICATE OF CORRECTION

PATENT NO. : 5,558,328

DATED : September 24, 1996

INVENTOR : Tomas Krantz

It is certified that error appears in the above-identified patent and that said Letters Patent is hereby corrected as shown below:

column 8, line 49, please replace "than" with --that--;

column 9, line 28, after "the" please delete "B";

column 9, line 67, please replace "2" with --3--; and column 11, line 46, please replace "am" with --are--.

Signed and Sealed this

Ninth Day of September, 1997

Bruce Lehman

*Attest:*

BRUCE LEHMAN

*Attesting Officer*

*Commissioner of Patents and Trademarks*